US011280117B2

(12) United States Patent
Beck et al.

(10) Patent No.: US 11,280,117 B2
(45) Date of Patent: Mar. 22, 2022

(54) DOOR-HANDLE SYSTEM FOR VEHICLES

(71) Applicant: Huf Hülsbeck & Fürst GmbH & Co. KG, Velbert (DE)

(72) Inventors: Andreas Beck, Bochum (DE); Markus Bartels, Mülheim (DE); Coen Dieker, Dinxperlo (NL)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 1126 days.

(21) Appl. No.: 15/122,228

(22) PCT Filed: Feb. 24, 2015

(86) PCT No.: PCT/EP2015/053856
§ 371 (c)(1),
(2) Date: Aug. 29, 2016

(87) PCT Pub. No.: WO2015/128332
PCT Pub. Date: Sep. 3, 2015

(65) Prior Publication Data

US 2016/0369532 A1 Dec. 22, 2016

(30) Foreign Application Priority Data

Feb. 28, 2014 (DE) ..... 10 2014 102 682.9

(51) Int. Cl.
*E05B 79/06* (2014.01)

(52) U.S. Cl.
CPC ..... *E05B 79/06* (2013.01)

(58) Field of Classification Search
CPC ..... E05B 79/04; E05B 79/06; E05B 85/10; Y10S 292/64; Y10S 292/53; Y10T 292/57
(Continued)

(56) References Cited

U.S. PATENT DOCUMENTS 5,706,554 A * 1/1998 Ruckert ..... E05B 9/084 16/438
6,363,577 B1 4/2002 Spitzley
(Continued)

FOREIGN PATENT DOCUMENTS

DE 19950172 A1 * 4/2001 ..... E05B 79/06
DE 10151870 A1 * 5/2003 ..... E05B 83/36
(Continued)

OTHER PUBLICATIONS

Machine Translation of EP 1306503 A1, 2020, pp. 1-15 (Year: 2020).*
(Continued)

*Primary Examiner* — Christine M Mills
*Assistant Examiner* — Yahya Sidky

(57) ABSTRACT

A door handle system for actuation of a moveable part of a vehicle particularly a door or a hatchback door or suchlike, comprises: a carrier which can be assembled at the inner side of the movable part; a door handle which can be assembled at the outer side of the moveable part by the carrier, wherein the door handle comprises two ends over its longitudinal extension at which connection means are intended respectively for the assembly at the carrier; a fastening element which serves for the assembly of the door handle by at least a connection means at the carrier, wherein the fastening element comprises at least one release position and a fixing position; and an adjustment element which serves for an adjustment of the fastening element between the release position and the fixing position.

37 Claims, 4 Drawing Sheets

(58) Field of Classification Search
USPC ..... 292/336.3, DIG. 64, DIG. 53
See application file for complete search history.

(56) References Cited

U.S. PATENT DOCUMENTS

| | | | | |
|---|---|---|---|---|
| 7,344,168 | B2 * | 3/2008 | Matsubara | E05B 79/06 292/336.3 |
| 7,971,913 | B2 * | 7/2011 | Sunahara | E05B 85/16 292/336.3 |
| 9,039,050 | B2 * | 5/2015 | Muller | E05B 85/16 16/110.1 |
| 2013/0020816 | A1 * | 1/2013 | Saitou | E05B 79/06 292/336.3 |

FOREIGN PATENT DOCUMENTS

| | | | | |
|---|---|---|---|---|
| DE | 102007052777 | A1 * | 5/2008 | E05B 85/16 |
| DE | 102007027845 | | 12/2008 | |
| DE | 102018107503 | A1 * | 10/2019 | E05B 85/10 |
| DE | 102018107504 | A1 * | 10/2019 | E05B 85/06 |
| EP | 1306503 | A1 * | 5/2003 | E05B 79/06 |
| EP | 1355022 | | 10/2003 | |
| EP | 1355022 | A2 * | 10/2003 | E05B 79/06 |
| EP | 1797960 | | 6/2007 | |
| WO | WO 96/03911 | | 2/1996 | |
| WO | WO 02/02894 | | 1/2002 | |
| WO | WO 02/092947 | | 11/2002 | |
| WO | WO 2015/128332 | | 9/2015 | |

OTHER PUBLICATIONS

Machine Translation of DE 102007052777 A1, 2021, pp. 1-10 (Year: 2021).*

Machine Translation of EP 1355022 A2, 2021, pp. 1-14 (Year: 2021).*

International Search Report and the Written Opinion dated Jun. 5, 2015 From the International Searching Authority Re. Application No. PCT/EP2015/053856 and Its Translation of Search Report Into English.

* cited by examiner

DOOR-HANDLE SYSTEM FOR VEHICLES

RELATED APPLICATIONS

This application is a National Phase of PCT Patent Application No. PCT/EP2015/053856 having International filing date of Feb. 24, 2015, which claims the benefit of priority of German Patent Application No. 10 2014 102 682.9 filed on Feb. 28, 2014. The contents of the above applications are all incorporated by reference as if fully set forth herein in their entirety.

FIELD AND BACKGROUND OF THE INVENTION

The present invention relates to a door handle system for actuating a movable part of a vehicle, particularly a door or a hatchback door or the like according to the preamble of claim 1. Thereby, a carrier is provided at the door handle system which can be arranged at the inner side of the moveable part. Further, the door handle system comprises a door handle which can be arranged at the outer side of the moveable part by a carrier and the door handle comprises two ends via its longitudinal extend at which connection means are intended respectively for the assembly at the carrier. Further, a door handle system comprises a fastening element which serves for the fixation of the door handle at the carrier by at least one connection means wherein the fastening element comprises at least one release position and one fixing position and an adjustment element which serves for the adjustment of the fastening element between the release position and the fixing position. Further, the present invention is further directed to a method for mounting of a door handle system for actuating a moveable part of a vehicle according to the preamble of claim 20.

From reference DE 10 2007 027 845 A1, for example, a door handle system for actuating of a moveable part of the vehicle, particularly a door or a hatchback door, is known with which a carrier is assembled at the inner side of the moveable part and serves for the fixation of a door handle at an outer side of the moveable part. Thereby, the door handle comprises a first handle end and a second handle end which are assembled via a complex composition at the carrier of the door handle system. A mounting of the door handle at the carrier by multiple complex mounting steps is necessary.

SUMMARY OF THE INVENTION

Therefore, it is object of the present invention to provide a door handle system and a method for mounting a door handle system which at least partly avoids the disadvantages of the state of the art. Particularly, it is an object of the present invention to facilitate the mechanic composition of the door handle system for fixation of the door handle at the carrier and the mounting at the moveable part.

The present object is solved by a door handle system with the features of claim 1, particularly from the characterizing clause. Besides, for solving the object an assembly method for mounting a door handle system with the features of claim 20, particularly the characterizing clause, is intended. In the dependent device and method claims preferred embodiments of the invention are listed. Features which are disclosed concerning the door handle system according to the invention thereby further apply for the assembly method according to the invention and vice versa. Further, the assembly method according to the invention from claim 20 can be performed with the door handle system according to the invention.

The door handle system according to the invention for actuation of a moveable part of a vehicle, particularly a door or hatchback door or suchlike, is equipped with a carrier which can be arranged at the inner side of the moveable part. Additionally, the door handle system comprises a door handle which can be arranged at the outer side of the moveable part by a carrier. The door handle comprises two ends over its longitudinal extension at which connection means are intended respectively for the assembly at the carrier. Such a door handle is, for example, equipped as a pulling handle. In order that the connection means can mechanically interact with the carrier for the assembly, in the moveable part corresponding openings can be intended through which the connection means protrude. Further, the door handle system is configured with a fastening element which serves for a particularly form fitting attachment of the door handle by at least one connection means at the carrier. Hereby, the fastening element comprises at least one release position and one fixing position. In the release position the door handle is released and therewith not directly or indirectly attached to the carrier. In the fixing position however the door handle is attached directly or indirectly at the carrier by the fastening element. Further, the door handle system comprises an adjustment element which serves for the adjustment of the fastening element between the release position and the fixing position. Therewith, the fastening element is moved back and forth between the release position and the fixing position by the adjustment element. According to the invention, it is intended that the fastening element retains the door handle at the carrier in its fixing position by both connection means or the existing connection means. Thereby, at the same time the fastening means fixes the existing connection means of the door handle at the carrier. Therewith, the door handle can be mounted or assembled particularly easily and securely at the moveable part by the existing embodiment of the door handle system.

Within the scope of the invention it can be intended that the door handle is rigidly and immovably assembled at the moveable part. Thereby, the fastening element serves for a rigid assembly of the door handle at the carrier. Therewith, the door handle itself is immovably assembled at the carrier and therewith also at the moveable part. Particularly, with a rigidly configured door handle the construction of the whole door handle system is configured particularly easily.

Further, it is possible within the scope of the invention that the door handle can be moveably arranged at the moveable part, meaning it is turnable or pivotable or can be pulled out. Herefore, the door handle can be attached via a bearing block indirectly at the carrier by the fastening element. For the fixation of the moveable door handle one or all existing connection means of the door handle can be attached at the carrier via bearing blocks. The construction of the door handle system with a moveable door handle is due to the additional use of at least one bearing block constructed more complex than with a rigidly configured door handle. Additionally, with the door handle system with a moveable door handle equalising weights like crash locks or retaining pawls can be intended for increasing the safety, particularly during a crash. Besides, a moveable door handle appropriately serves for mechanically actuating a lock for closing the moveable part.

Further, it can be intended with the door handle system according to the invention that the fastening element is displaceably supported at the carrier, particularly between the release position and the fixing position. Therewith, only by a displacement of the fastening element from the release position into the fixing position the door handle can be formfittingly attached at the carrier. Herefore, the fastening element can be maintained via guiding means at the carrier. For this purpose the guiding means can be configured T-like at the carrier and formfittingly interact with elongated holes at the fastening element in order to form a guidance for the fastening element. Ideally, the elongated holes are configured with an extension in the fastening element in order to be able to introduce the fastening element via the head of the T-like guidance means. Advantageously, the distance of the extension from the elongated holes to the distance of the T-like guidance means is adjusted at the carrier which means that the distance is identical, respectively. After the fastening means with its extensions is guided from the elongated holes via the T-like heads of the guidance means at the carrier the fastening element only has to be displaced in longitudinal direction, wherein a formfitting guidance is realized between the fastening element and the carrier.

Optionally, it is possible within the scope of the invention that openings are intended at the moveable part for fastening of at least the carrier or the door handle. Connection means from the door handle reach through said openings in order to assembly the connection means with the carrier. The carrier itself can be arrangeable at the moveable part by at least one, preferably multiple, support means. Hereby, the support means, which can be configured hook-like, at least formfittingly engage the edges of the openings in the moveable part. Ideally, thereby the openings in the moveable part are used which are intended for the guidance to the door handle. In order to achieve a possible high stability of the moveable part the openings for the door handle should be configured geometrically complementary to the extending connection means of the door handle. The previously mentioned support means of the carrier extend from the inner side of the moveable part through the openings and engage with the outside of the edges of the openings.

In order to locally fix the carrier securely at the moveable part at least one fixation element can be intended that fixes the carrier at the moveable part. Hereby, it is possible that the fixation element is configured as a screw and interacts with a thread at the carrier in the assembly position at the moveable part. Therefore, after being initially formfittingly arranged in the moveable part via its support means, the carrier is fixed in its geometrical position at the moveable part by the fixation element. Hereby, it is ensured that the carrier remains in its desired position at the moveable part. Ideally, the fixation element is arranged with the door handle system in a way that it is covered by the door handle from the outside. The fixation element itself is normally inserted into the carrier from the outside through an opening in the moveable part and connected thereto, for example, by said thread.

Further, it is possible according to the invention that at the fastening element at least one preload means is arranged which mechanically interacts with the door handle in the fixing position. By this preload means the door handle is pressed to the outer side of the moveable part when the fastening element takes its fixing position. Therewith, the fastening element not only fulfils the attachment and fixation of the door handle at the carrier or at the moveable part, but at the same time provides a sufficient tilt stability, since the door handle is attached free of clearance and therewith free of movement at the movable part via the carrier. Preferably, the preload means can be configured as a flexible tongue at the fastening element which is particularly configured materially homogeneous from the fastening element. Therewith, the preload element is quasi configured as an indentation, which comprises curves or tapers, from the fastening element. Ideally, for each connection means of the door handle a preload means at the fastening element is intended in order to ensure a particularly secure attachment of the door handle. Within the scope of the invention it is possible that a lock cylinder is intended which serves for a mechanical release of a function with a security system of the vehicle. With the security system of the vehicle it can be an access verification system like, for example, the central locking system. Besides it can be an alarm system or an antitheft device which can be actuated or operated by a mechanical locking cylinder. The locking cylinder can thereby be attached at the moveable part by the carrier. Hereby, the fastening element can attach the locking cylinder at the carrier particularly form fittingly. Therewith, the fastening element not only serves for an attachment of the door handle at the carrier but at the same time for an attachment of the locking cylinder at the carrier.

In order to avoid a penetration of moisture through the openings of the moveable part it can be intended that between the door handle and the outer side of the moveable part at least one sealing element is intended. By the present sealing elements the openings and the moveable part are closed during the assembly of the door handles, since the door handle pushes to the sealing from the outside which again is pushed against the outer side of the moveable part in order to seal the area around the openings in the moveable part. Further, these seals effect that the door handle does not damage a painted surface of the outer side of the movable part.

In order to achieve an increased tilt stability of the assembled door handle at the moveable part, it is intended that the connection means which protrude into the carrier are surrounded by complimentary configured guiding areas in the carrier. Hereby, it is an advantage when the connection means possess a certain length since therewith the contacting area between the connection means and the complementary configured guidance areas at the carrier is enlarged.

According to the invention it is predictable that the fastening element comprises at least one first and one second section. Thereby, the second section can be intended for an attachment of the door handle at the carrier and the first section can be intended for the attachment of the lock cylinder. Therewith, separated functions of the fastening elements are allocated to the first and second section respectively.

Further, it is possible within the scope of the invention that at least at the second section of the fastening element counter guiding means are intended which interact with the guiding means at the carrier particularly formfittingly. Therewith, the fastening element is at least also kept and, if necessary, also guided at least at the second section at the carrier. Additionally, the second section serves for an attachment of the door handle at the carrier.

With a particularly elegant configuration of the invention it can be intended that the fastening element is configured at least from only one part, from the same material or monolithic. Therewith, the fastening element is a consistent component which is not assembled from multiple assembly parts. The fastening element can for example be configured in form of a spacer which, however, can comprise a vertically offset contour, which is configured ideally geometrically complementary to a contour of the carrier, in order to interact with the contour of the carrier within the scope of a guidance. Besides, it is possible that the material thickness of the fastening element varies, wherein particularly critical portions of the fastening element are configured with a bigger material thickness. These critical portions can be areas around the fastening means of the fastening element.

Besides, it is possible according to the invention that the fastening element is configured at least from two parts. Hereby, a first part can be configured from a first section and the second part from a second section of the fastening element. Thereby, it is possible to use different materials or material thicknesses of the fastening elements for the respective sections. Thus, for example the first part of the fastening element can consist of a casting part, particularly a metal casting part or a light metal casting part. The second part of the fastening element, however, can consist of a forged part or a rolled plate part. The mechanic connection between the first and second part of the fastening elements can be realized by a connection means. Ideally, thereby both parts of the fastening means can be at least attached form-fittingly to one another by the connection means. Further, a materially bond connection between the first and the second part of the fastening element is possible. The assembly of the two part fastening element can be facilitated when both parts are only connected to one another after the assembly at the carrier. However, also an attachment of the fastening element at the carrier in a jointed version of the first and second part of the fastening element is possible. With a further measure improving the invention it can be intended that the adjustment element is particularly mounted directly at the carrier in a recess and that the fastening element is longitudinally displaceable between the release position and the fixing position. Hereby, the adjustment element quasi serves as a gear for the fastening element. The adjusting element can be configured itself as a screw or spring element particularly with a latching means. The adjustment means configured as a screw is thereby pivotably but stationary mounted with its screw head in the recess of the carrier. The thread of the screw however is screwed in a thread of the fastening element. A turning of the screw mounted in the carrier recess effects that the fastening element is longitudinally displaceable along the thread of the screw. Provided that the adjustment element is configured as a spring element this spring can itself support in the acceptance at the carrier and push against the displaceable fastening element in order to transfer this from the release position into the fixing position. Ideally, the adjustment element configured as a spring element comprises a resting means wherein the spring element can be kept in a starting position in which the fastening element is in its release position. Thereby, that the latching means is released from the spring element in the acceptance at the carrier the spring force of the spring element automatically pushes the fastening element in the fixing position. Since the spring force of the spring element acts permanently to the fastening element this is securely kept in the fixing position. A displacement of the fastening element from the fixing position into the release position can, for example, occur by a turning back of the adjustment element configured as a screw or by a counter pressure to the fastening element contrary to the spring force of the spring element.

In order to avoid manipulations of the mounted door handle the adjustment element can be accessible and adjustable by a breakthrough in the moveable part. Hereby, it is recommended that the adjustment element is, however, not accessible from the outside of the moveable part. Rather, the moveable breakthrough in the moveable part can be arranged at the front which is only accessible when the moveable part is at least partially opened, wherein the front is released. In order to improve the assembly of the door handle system at the moveable part, it can be intended that the adjustment element is form-fittingly connected to the fastening element. Hereby, it can be achieved that the adjustment element is directly connected to the fastening element and a movement of the adjustment element directly acts on the fastening element. For this purpose the adjustment element can be directly connected to the fastening element via a thread or the adjustment element is connected to the fastening element in a material bond manner or the adjustment element is for example riveted, welded, soldered or glued to the fastening element.

Optionally, it is possible within the scope of the invention that at least one connection means of the door handle is at least configured in a one-piece, from the same material or monolithic with the door handle. Therewith, the connection means are quasi constituted by the door handle itself. The connection means can be welded or injected onto the door handle or can be screwed to the door handle. Advantageously, the connection means can protrude rod-like from the edges of the door handle and are particularly adjusted mainly orthogonally to the longitudinal extension of the door handle. By the orthogonal assembly of the connection means to the longitudinal extension of the door handle it can be achieved that the door handle is mountable through a mainly vertical introduction to the moveable part.

It can be further intended according to the invention that both connection means from the door handle can be oriented in parallel to one another. Hereby, it is possible that the connection means comprise a different length. Especially, with the non-symmetrical outer contour of the door handle a filling measuring fitted to the geometry of the connection means to the moveable part or the arranged carrier is recommended.

Further, it is possible according to the invention that at the fastening element fastening means are assembled which are particularly intended at the second section. Hereby, the fastening means mechanically act together with the fixing position of the fastening element with the counter fixing means at the connection means of the door handle. This mechanical interaction is normally form-fittingly such that quasi the fastening means of the fastening element lock the connection means with the help of the counter fastening means. Hereby, the counter fastening means can be configured at the connection means as grooves in which the fastening means of the fastening element pull in by a displacement in the fixing position. In order to facilitate this pulling in, at least one start up slope at at least one fastening means or the counter fastening means can be intended.

Provided that the counter fastening means at the connection means of the door handle are configured as grooves, the start up slopes are available at the fastening means. Besides, at the same time at the fastening means and from the fastening element start up slopes can exist which are geometrically adjusted to the mechanically interacting slope up shapes at the door handle. Here it should be mentioned that the counter fastening means at the connection means do not necessarily have to consist of grooves or recesses, but rather they can be indentations which can form fittingly interact with the fastening means of the fastening element. Ideally, the fastening means of the fastening element encompasses the counter fastening means and the connection means of the door handle on both sides wherein a particularly secure form fit for the assembly of the door handle at the moveable part results. Additionally, besides the already mentioned preload means can be intended at the fastening means whereby a further increased assembly of the door handle is achievable.

The door handle system according to the invention can optionally be configured with at least one electronic unit which is connectable to a security system of technical vehicle data via cable or via radio. Hereby, it is possible that at least a part or the whole electronic can be arranged in the door handle. Thus, in the door handle, for example, at least one proximity sensor, an antenna for the communication with an external mobile identification device or a switching element can be provided, wherein the comfort of the door handle system can be improved. Hereby, for example a passive keyless entry or an active keyless entry and the passive keyless-go system can be realized. For this purpose it is intended that in the door handle a hollow space is intended which receives at least a part of the electronic unit. Further, the arrangement of a part of the electronic unit in the door handle provides the advantage that between an approximation of an operator to the vehicle and an interference of the operator in the recess grip, which is configured by the door handle and the movable part, it can be metrologically differentiated. Hereby, the comfort with the approaching vehicle through the door handle system according to the invention can be significantly improved.

Further, it is possible that the previously described electronic unit comprises a light module which can preferably be assembled in the door handle in order to realize an apron lightning. Besides, in the door handle a data interface can be available in form of a Bluetooth or NFC (nearfield communication) interface. By these interfaces an external data exchange between the security system or the vehicle electronic with an external device is possible in a simple manner without performing an access to the vehicle.

In order to be able to connect the door handle via a data connection with the security system or the electronic unit in the vehicle, it can be intended that at least at one connection means of the door handle an electric plug connection is arranged which electrically interacts with a counter plug connection at the carrier. Ideally, the electric plug connection at the connection means of the door handle is configured in a way that it automatically is connected with a counter plug connection at the carrier when the door handle is inserted in the opening at the moveable part in the carrier. A locking or attachment of the door handle by a displacement of the fastening element at the same time leads to a locking of the plug connection with the counter plug connection. In this manner the assembly of the door handle system according to the invention can be further facilitated. Moreover, such a configuration of the electric plug connection at the connection means comprises the advantage that a plug no longer has to be manually connected from the inner side of the moveable part with the counter plug connection. Further, it is possible that between the connection means and the electric plug connection an electric wire is intended with which the plug connection of the door handle is geometrically flexibly arrangeable at the carrier or can take place at the inner side of the moveable part.

It should be further mentioned at this point that at least the door handle or the carrier are producible as an injection moulding part particularly from plastic. The door handle from plastic comprises the advantage that the electronic unit is partly arrangeable in the door handle without further effort. Thereby, the plastic advantageously shields no electromagnetic fields. In order to achieve a particularly stable configuration of the door handle system the carrier can at least partially consist of a metal casting, particularly light metal casting. Further, it is an advantage when the carrier comprises honeycombed reinforcement rips which increase the stability of the carrier and at the same time reduce the weight. Ideally, these guidance means for the fastening means are already injected at the carrier.

The present invention is further directed to a security system for a vehicle with the door handle system according to the invention. Besides, the invention comprises a vehicle with at least a door handle system according to the invention or a security system according to the invention.

The present invention is further directed to a method for the assembly of a door handle system for actuation of a moveable part of a vehicle, particularly a door or a hatchback door or suchlike, according to the preamble of claim 20. According to the invention with such an assembly method it is intended that the following steps for the assembly of the door handle system at the moveable part of the vehicle have to be performed:

a) Fastening of the carrier at the inner side of the moveable part b) Linear insertion of the connection means of the door handle from the outer side through the opening in the moveable part into the carrier c) Formfitting fixation of the door handle by adjustment of the fastening element from the release position into the fixing position According to steps a, b and c it has to be noticed that these can be timely performed in the order a, b, c. Further, a subdivision of said steps can occur. Thus, it is for example possible that in step c by an adjustment of the fastening means in the fixing position both connection means are fixed. Hereby, the fastening element can only be displaced linearly. Like previously described, the displacement can be formed automatically when for example the adjustment element comprises a spring which raises the necessary adjustment force.

Further, it is possible that with step a the carrier is initially plugged to the moveable part and subsequently secured with a fixing element at the moveable part. The plugging of the carrier at the moveable part can occur by the already described support means at the carrier. Further, a step b1) can be intended with which a locking cylinder is inserted from the inner side of the moveable part into the carrier in order to be attached to the carrier. Herefore, step c) can serve, which by the adjustment of the fastening element in the fixing position at the carrier by the fastening element at the same time the locking cylinder is fixed. Therewith, at the same time the locking cylinder and the door handle are formfittingly retained in step c) by the fastening element in the fixing position.

Besides with the assembly method according to the invention the door handle system according to the invention can be used with all features previously described.

BRIEF DESCRIPTION OF THE SEVERAL VIEWS OF THE DRAWINGS

Further measures and advantages of the present invention result from the claims, the subsequent description and the drawings. Likewise, the disclosed features from the door handle system according to the invention apply for the assembly method according to the invention and vice versa. In the drawings the invention is shown in different embodiments. Thereby, the features described in the claims and in the description can be essential for the invention each single by themselves or in any combination. It is shown:

In the subsequent figures for the same technical features also from different embodiments the same reference signs are used.

DESCRIPTION OF SPECIFIC EMBODIMENTS OF THE INVENTION

Figure 1:
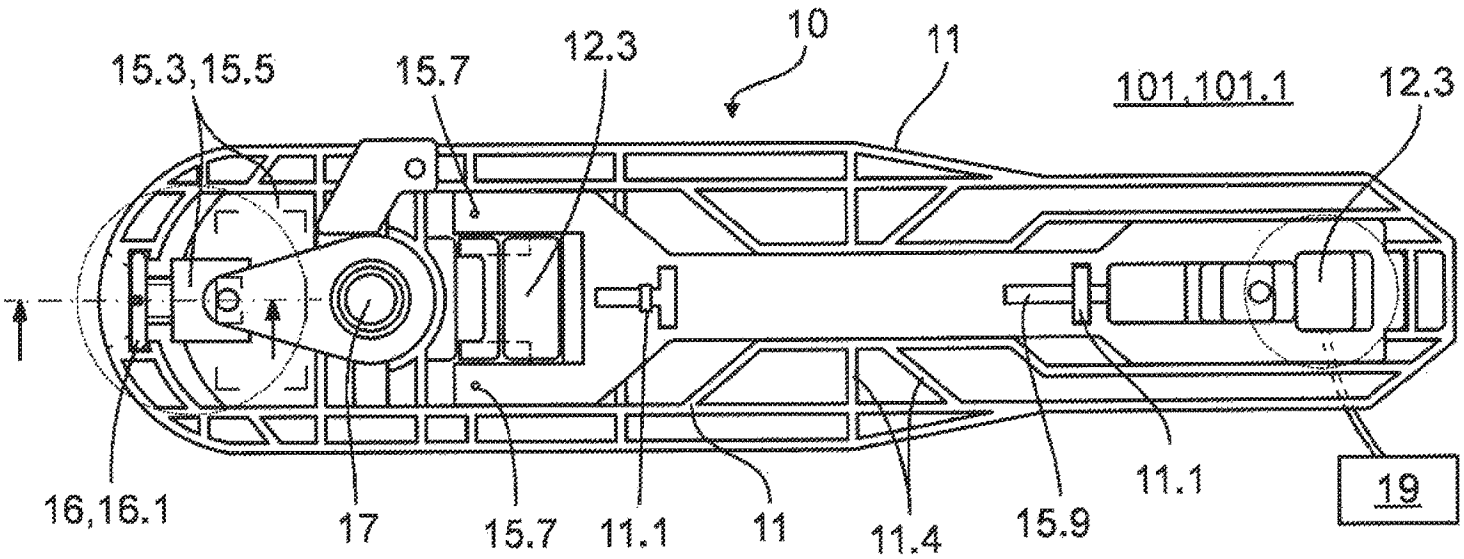
FIG. 1 a schematic rear view of a door handle system according to the invention with the carrier assembled at the inner side of the moveable part FIG. 2*a* a detail enlargement of FIG. 1 of an adjustment element of the door handle system according to the invention FIG. 2*b* a comparable detail enlargement from FIG. 2*a*, but with a differently configured adjustment element FIG. 2*c* an exemplary detail enlargement of the right fastening area of the door handle at the carrier from FIG. 1

FIG. 1 shows a rear view of a door handle system 10 according to the invention which is assembled at the inner side 101.1 at the moveable part 101 of the vehicle 100. Consequently, only the connection means 12.3 of the mounted door handle 12 are visible which serve for attachment of the door handle 12 at the carrier 11. For this purpose the fastening element 15 is intended at the carrier 11 which is configured in form of a slide. The fastening element 15 itself is formfittingly retained at the carrier 11 via guidance means 11.1, for what counter guidance means in form of longitudinal holes with an enlargement at the fastening element 15 are intended. The fastening element 15 shown in FIG. 1 comprises a first section 15.3, a second section 15.4, wherein the first section 15.3 mainly corresponds to a first part 15.5 and the second section 15.4 mainly corresponds to a second part 15.6. The first part 15.3 thereby serves for formfittingly securing a possibly existing locking cylinder 17 at the carrier 11. In this FIG. 1 only the rear side of the locking cylinder 17 can be recognized, which is connected to a lever of the locking cylinder for the transmission of the mechanic turning movement. The second section 15.4 serves for an assembly of the door handle 12, particularly through the connection means 12.3 of the door handle. The exact functionality is further explained in detail in FIGS. 3, 4, 5 and 6. Further, it can be recognized in FIG. 1 that the fastening element 15 is configured of two parts 15.5, 15.6 in the present case, wherein both parts are formfittingly connected to one another by the both shown connection means 15.7. These connection means 15.7 can consist of bolts which extend from the first part 15.5 of the fastening element 15 and form fittingly interact with holes in the second part 15.6 of the fastening element 15. The adjustment element 16 can be configured as rivets or screws. It is further possible that both parts 15.5, 15.6 are connected to one another in a material bound manner. Like previously described, it is further conceivable that the whole fastening element 15 is configured in one part.

In FIG. 1 at the left edge of the carrier 11 an acceptance 11.3 for the adjustment element 16 is shown which is shown in form of a screw 16.1. Likewise, the honeycombed structure of the carrier 11 can be recognized with its reinforcement rips 11.4.

Figure 2C:
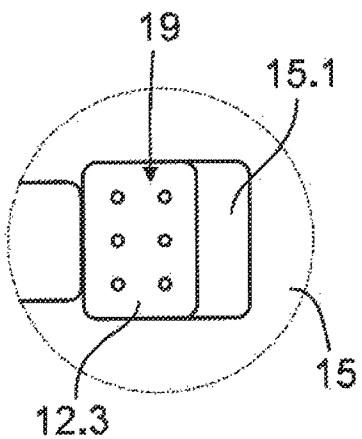
Figure 2B:
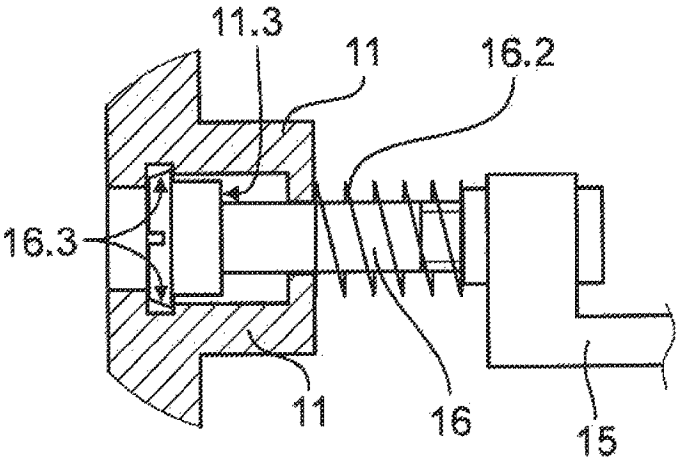
Figure 2A:
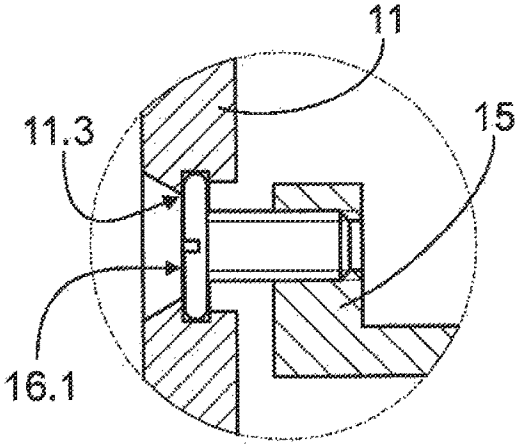

In FIG. 2*a* a detail enlargement of the left area of the carrier 11 with the adjustment element 16 is shown. Hereby, it is significant that the adjustment element 16 is configured as an adjustment screw 16.1. The screw head is thereby formfittingly retained, but turnable in the acceptance 11.3 of the carrier 11. Hereby, it is effected that the adjustment element 16 remains stationary at the carrier 11. The thread of the screw 16.1 acts with a thread of the fastening means 15, particularly in the first section 15.3. Thereby, a turning of the screw through the existing breakthrough in the carrier 11 leads to a longitudinal displacement of the whole fastening element 15. Therewith, the fastening element 15 can be moved from a release position l in the fixing position II and possibly back by a turning of the adjustment screw 16.1. Therewith, it is significant that the whole door handle 12 can be moved between a release position I and a fixing position II only by an actuation of the adjustment element 16.

In the further FIG. 2*b* an optional configuration of the adjustment element 16 is shown comparable to thle detail enlargement in FIG. 2*a*. Hereby the adjustment element 16 is shown as a spring 16.2 which advantageously comprises a latching means 16.3. Like it can be recognized, the adjustment element 16 is again retained in an acceptance 11.3 of the carrier 11. Thereby, initially the adjustment element 16 is retained by the existing latching means 16.3 in indentations in the acceptance 11.3. If now the screw-like adjustment element 16 is turned by a vehicle key base in the head area, the latching means 16.3 fall out of the indentations and the spring 16.2 pushes the whole adjustment element 16, whereby the fastening element 15 is transferred from its release position I in the fixing position II. For this purpose the adjustment element 16 is tightly connected with the fastening element 15. The assembly of such a door handle system according to the invention is particularly easy, since the arresting of the door handle 12 is achievable only by a slightly turning of the adjustment element 16.

In a further FIG. 2*c* an enlargement of the right connection means 12.3 of the door handle 12 from FIG. 1 is shown as an example. Hereby, the front of the connection means 12.3 comprises contacts of the plug connection 19 which is electrically connectable to a counter plug connection at the carrier 11. Therewith, the attachment of the door handle 12 in the carrier 11 at the same time leads to an electrical connection of the part of the electronic unit 13 arranged in the door handle with the carrier 11 or the vehicle related electronic. Optionally, a cable with the plug connection 19 can be guided out of at least one connection means 12.3 like it is indicated in FIG. 1.

Figure 3:
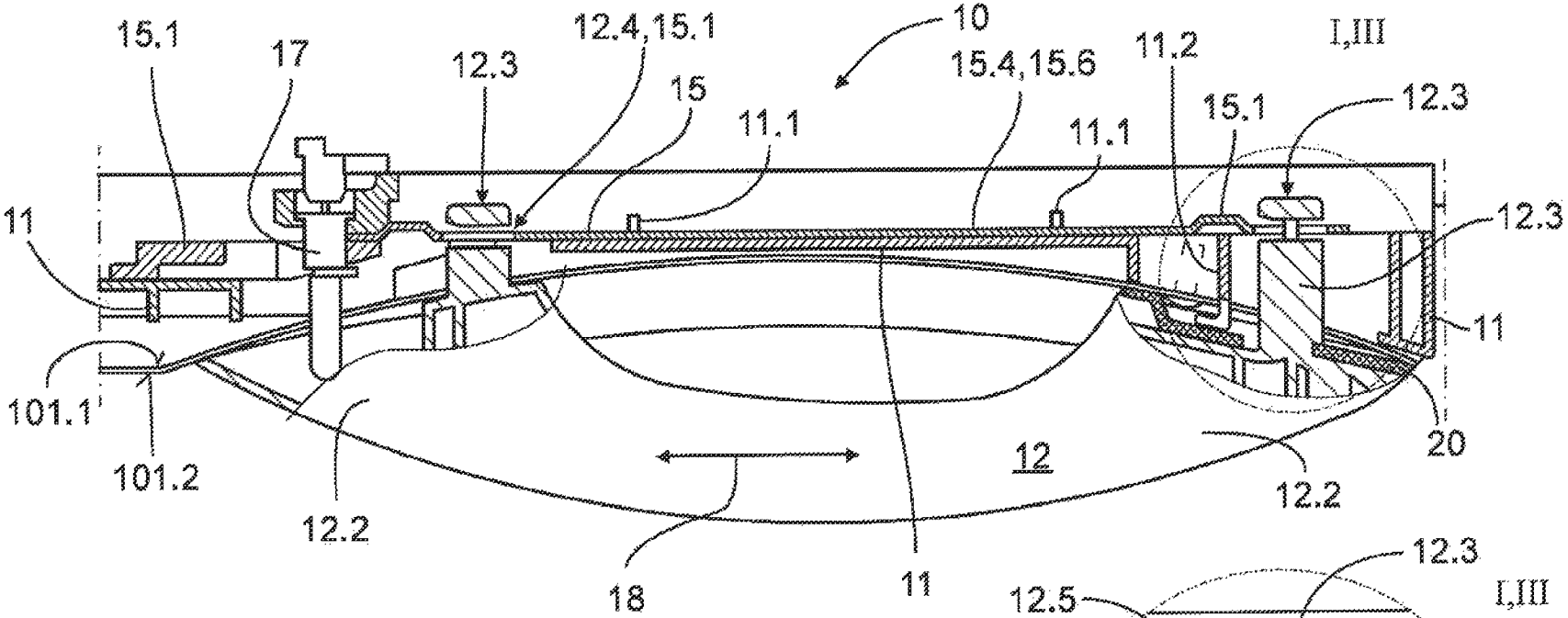
FIG. 3 a partly sectional view by the door handle system according to the invention from FIG. 1 in a release position of a fastening element FIG. 4 an enlargement of the right fastening area of the door handle of FIG. 3

In FIG. 3 a door handle system 10 according to the invention is shown in a partly cross section via the longitudinal extension 18. The fastening element 15 is thereby in its release position I wherein the carrier 11 has already turned into its assembly position III at the moveable part 101. Like it can be recognized the fastening element 15 is configured of two parts 15.5 and 15.6. The first part 15.6 can therewith be configured as a casting in order to achieve a particularly secure assembly of the lock cylinder 17 at the carrier 11. This lock cylinder 17 is likewise form-fittingly secured by a displacement of the fastening element 15 from the release position I into the fixing position II. Therefore, the fastening element 16 transfers with its first section 15.3 behind a passage of the locking cylinder 17 wherein a form fit is configured. The second part 15.6 of the fastening element 15 is configured sheet-like and comprises two breakthroughs for the connection means 12.3 of the door handle 12. In the assembly position III of the carrier 11 and the release position I of the fastening element 15 the door handle 12 is put through openings 101.3 in the moveable part 100, wherein at the same time the connection means 12.3 are partly guided through the carrier 11. Like it can be further recognized in FIG. 3 the door handle 12 comprises a longitudinal extension 18, wherein the door handle comprises two ends 12.2. At both ends 12.2 rod-like connection means 12.3 extend which are mainly adjusted orthogonal to the longitudinal direction 19 of the door handle 12. The previously described seals can be pushed over these rod-like connection means 12.2.

Figure 4:
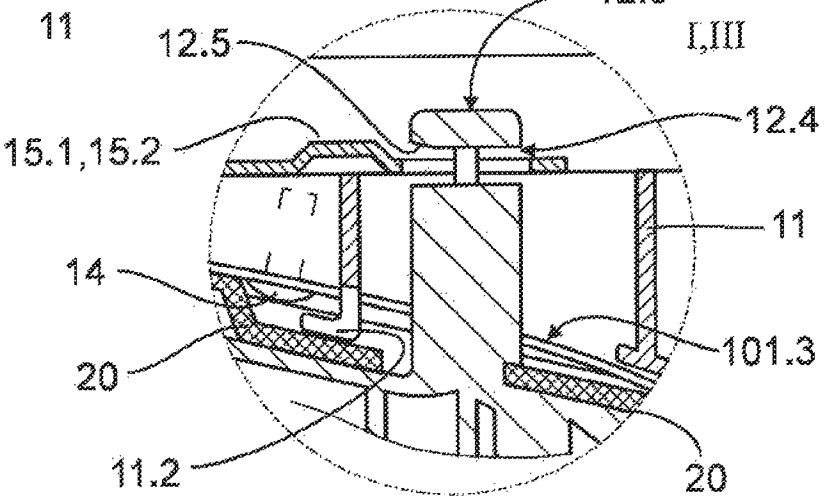
Figure 5:
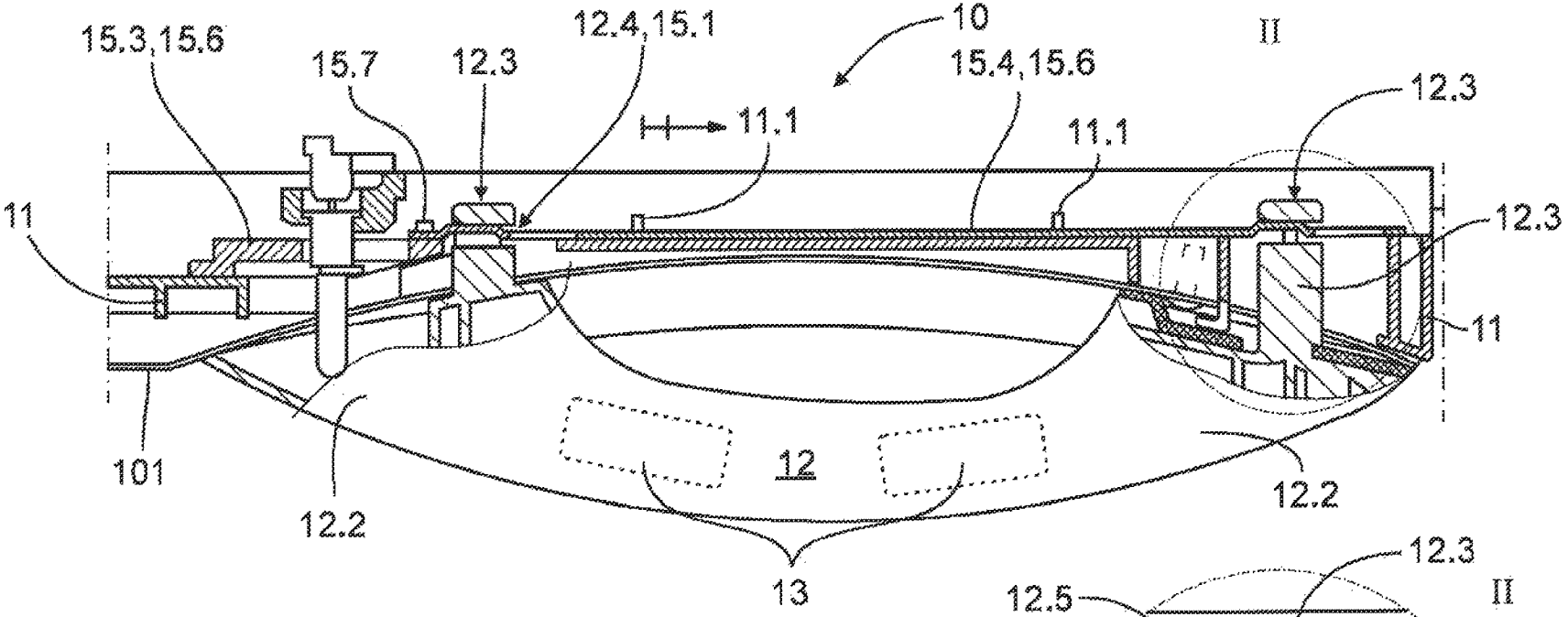
FIG. 5 a comparable sectional view through the door handle system according to the invention from FIG. 3, but in a fixing position of the fastening element FIG. 6 a detail enlargement from FIG. 5 of the right fastening area comparable to FIG. 4 and FIG. 7 a schematic view of a vehicle with a door handle system according to the invention.

By means of FIG. 4 it can be recognized how the carrier 11 is retained with a hook-like support means 11.2 in the assembly position III at the moveable part 101. Additionally, a fixation element in form of a screw is intended in order to adjust and retain the carrier 11 exactly at the moveable part 101. The fixing element 14 is configured in form of a screw and is guided through the moveable part 101 at the outer side 101.2 and acts together with a thread at the carrier 11 which is indicated accordingly in FIG. 4. Further, a sealing 20 is intended around the opening 101.3 between the door handle 12 and the movable part 101. From the further FIGS. 5 and 6 the locking of the door handle 12 at the carrier 11 arises. For this purpose the fastening element 15 is transferred from its release position I to its fixing position II, by an actuation of the adjustment element 16. This transmission occurs in the present case by a pure linear movement of the fastening element 14. Thereby, the whole fastening element 15 is displaced along the guidance means 11.1 at the carrier 11. Herefore, corresponding longitudinal holes 15.9 are intended in the fastening element 15.

Figure 6:
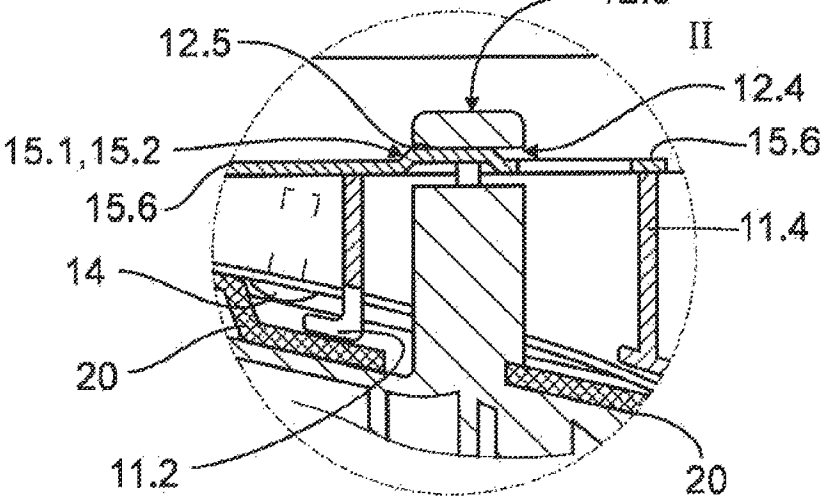

In FIG. 6 the generated form fit between the fastening element 15 and the door handle 12 can be recognized. For this purpose fastening means 15.1 are intended configured as projections at the fastening element 15 which pull in to recesses or grooves in the connection means 12.3. These recesses or grooves configure a counter fastening means 12.4 for the fastening means 15.1. In order to facilitate the pulling in of the fastening means 15.1 into the counter fastening means 12.4, start up slope 12.5 are intended at the counter fastening means 12.4 and the fastening means 15.1. Additionally, the fastening means 15.1 comprise preload means 15.2 as spring tongues, wherein an increased contact pressure of the door handle 12 is effected at the outer side 101.2 of the movable part 100. These preload means 15.2 are configured as trapeze-like configurations of the fastening means 15.1, wherein the bevels at the same time configure start up slope for the counter fastening means 12.4 of the door handle 12. The fastening means 15.1 extend on both sides into the counter fastening means 12.4 from the connection means 12.3. Therewith, a selective locking of the door handle 12 can be avoided, wherein likewise the stability of the assembly can be significantly increased.

Figure 7:
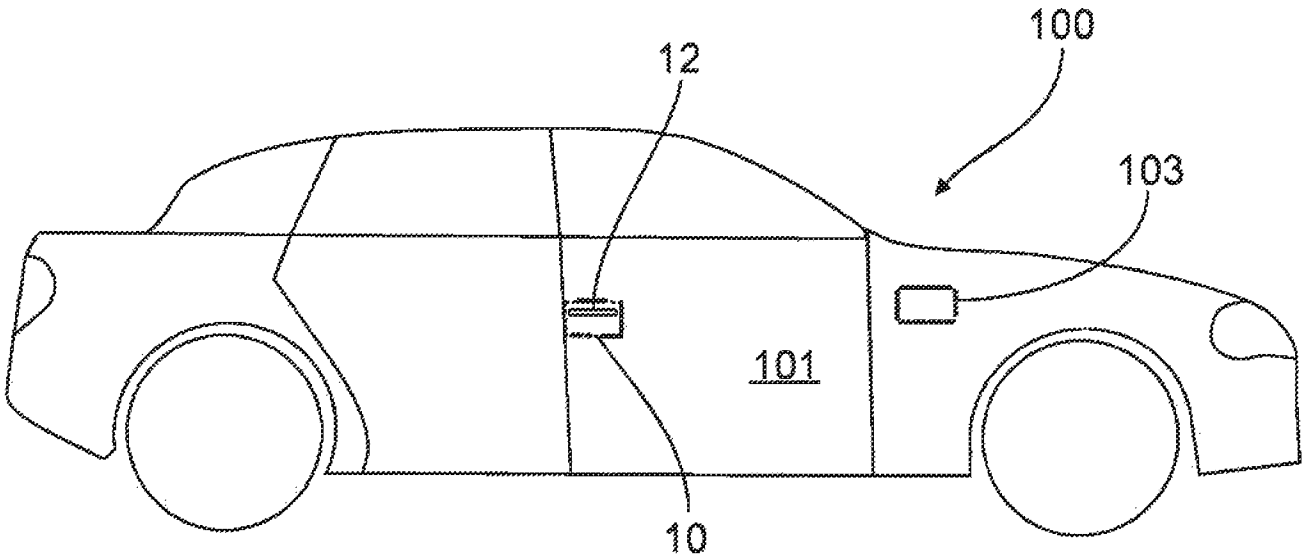

In FIG. 7 a vehicle 100 according to the invention with a security system 103 is intended. Thereby, the door handle system according to the invention is shown at the moveable part 101 which shows a vehicle door.

REFERENCE LIST

10 Door handle system
11 Carrier
11.1 Guiding means for 15
11.2 Support means for 101
11.3 Acceptance for 16
11.4 Reinforcement rips
12 Door handle, particularly stationary
12.1 Handle
12.2 End
12.3 Connection means
12.4 Counter fastening means for 15
12.5 Start up slope
13 Electronic unit of 10/12
13.1 Part of the electronic unit 12
14 Fixation means for 11, preferably screw
15 Fastening element
15.1 Fastening means for 12
15.2 Preload means
15.3 First section
15.4 Second section
15.5 First part
15.6 Second part
15.7 Connection means
15.8 Counter guiding means
15.9 Elongated hole for 11.1
16 Adjustment element
16.1 Screw
16.2 Spring
16.3 Latching means
17 Locking cylinder
18 Longitudinal extension of 12
19 Plug connection
20 Sealing for 12
100 Vehicle, particularly motor vehicle
101 Moveable part
101.1 Inner side
101.2 Outer side
101.3 Opening
102 Lock, particularly electromechanical
103 Security system
I Release position of 15
II Fixing position of 15
III Assembly position of 11

What is claimed is:

1. Door handle system for actuation of a moveable part of a vehicle, comprising:

a carrier which is arrangeable at an inner side of the movable part, a door handle which is arrangeable at an outer side of the moveable part by the carrier, and the door handle comprises two ends over a longitudinal extension of the door handle, wherein at each end connection devices are provided respectively for attachment of the door handle at the carrier, a fastening element which serves for the attachment of the door handle by at least one connection device at the carrier, wherein the fastening element comprises at least one release position and a fixing position and an adjustment element which serves for an adjustment of the fastening element between the at least one release position and the fixing position wherein the fastening element retains the door handle by both connection devices at the carrier in the fixing position, wherein the fastening element is a single integral part and is configured to receive and fix both of the connection devices, wherein the fastening element has a first end and a second end, wherein the first and the second end are arranged on opposite sides of the fastening element, so that in the fixing position one of the two connection devices is fixed at the first end of the fastening element and the other one of the two connection devices is fixed at the second end of the fastening element;

wherein the door handle is rigidly and stationary arrangeable at the moveable part.

2. Door handle system according to claim 1, wherein the fastening element is displaceably retained at the carrier.

3. Door handle system according to claim 1, wherein for the attachment of at least the carrier or the door handle openings are provided at the moveable part and that the carrier is arrangeable at the moveable part by at least one, support means.

4. Door handle system according to claim 1, wherein the carrier is fixable by at least one fixing element at the moveable part.

5. Door handle system according to claim 1, wherein the fastening element comprises at least one preload means at the first end and at least one preload means at the second end, wherein each of the preload means mechanically interacts in the fixing position with the door handle, whereby the door handle is pressible at the outer side of the movable part.

6. Door handle system according to claim 1, wherein the fastening element comprises at least one first and one second section.

7. Door handle system according to claim 1, wherein the fastening element is retained with guidance means at the carrier, and at least at the second section of the fastening element further counter guidance means are provided which interact with the guidance means at the carrier.

8. Door handle system according to claim 7, wherein the fastening element is configured from one part, from one material or monolithic.

9. Door handle system according to claim 1, wherein a locking cylinder is provided which serves for a mechanical release of a function with a security system of the vehicle, wherein the locking cylinder is assembled at the moveable part by the carrier and the fastening element attaches the locking cylinder at the carrier.

10. Door handle system according to claim 1, wherein the fastening element is configured of two parts joined to be the single integral part, wherein a first part is configured from a first section and a second part is configured from a second section.

11. Door handle system according to claim 1, wherein the adjustment element is retained at the carrier in an acceptance and longitudinally displaces the fastening element between the at least one release position and the fixing position.

12. Door handle system according to claim 1, wherein the adjustment element is accessible and adjustable by a breakthrough in the movable part.

13. Door handle system according to claim 1, wherein the adjustment element is formfittingly connected to the fastening element.

14. Door handle system according to claim 1, wherein at least one connection device of the door handle is at least configured from one part, from one material or monolithic to the door handle.

15. Door handle system according to claim 1, wherein both connection devices of the door handle are oriented in parallel to one another.

16. Door handle system according to claim 1, wherein at the fastening element fastening means are assembled and that the fastening means mechanically interact in the fixing position of the fastening element with counter fastening means at at least one of the connection devices of the door handle.

17. Door handle system according to claim 1, wherein at least one electronic unit is provided which is configured to exchange data with a security system of the vehicle.

18. Door handle system according to claim 1, wherein at the door handle, an electric plug connection is assembled which electrically interacts with a counter plug connection at the carrier.

19. Method for the assembly of a door handle system for actuation of a moveable part of a vehicle, wherein the door handle system comprises a carrier which is arrangeable at an inner side of the movable part, a door handle which is arrangeable at an outer side of the moveable part by the carrier, and the door handle comprises two ends along its longitudinal extension, wherein at each end connection devices are provided respectively for the attachment at the carrier, and a fastening element which serves for the attachment of the door handle by at least one connection device at the carrier, wherein the fastening element comprises at least one release position and one fixing position, wherein the following steps for the assembly of the door handle system are performed at the moveable part of the vehicle:

a) Fastening of the carrier at the inner side of the moveable part b) Linear insertion of the connection devices of the door handle from the outer side through openings in the moveable part in the carrier c) Formfitting fixation of the door handle by adjustment of the fastening element from the at least one release position to the fixing position, wherein the fastening element is a single integral part and configured to receive and fix the connection devices, wherein the fastening element has a first end and a second end, wherein the first and the second end are arranged on opposite sides of the fastening element, so that in the fixing position one of the two connection devices is fixed at the first end of the fastening element and the other one of the two connection devices is fixed at the second end of the fastening element;

wherein the door handle is rigidly and stationary arrangeable at the moveable part.

20. The method for the assembly of a door handle system according to claim 19, wherein in step c) both connection devices are fixed by the adjustment of the fastening element in the fixing position.

21. The method for the assembly of a door handle system according to claim 19, wherein in step a) the carrier is initially plugged to the moveable part and subsequently secured with a fixing element at the moveable part.

22. The method for the assembly of a door handle system according to claim 19, wherein in a step b1) a locking cylinder is pushed into the carrier from the inner side of the moveable part and by the step c) at the same time fixed by the adjustment of the fastening element in the fixing position at the carrier.

23. The method for the assembly of the door handle system according to claim 19, wherein the door handle system comprises an adjustment element which serves for an adjustment of the fastening element between the at least one release position and the fixing position.

24. Door handle system according to claim 1, wherein the door handle is arrangeable by the fastening element.

25. Door handle system according to claim 2, wherein the fastening element is retained with guidance means at the carrier.

26. Door handle system according to claim 3, wherein the support means at least formfittingly engage opening edges of the openings in the movable part.

27. Door handle system according to claim 4, wherein the at least one fixing element is configured as a screw and interacts with a thread at the carrier in an assembly position at the moveable part.

28. Door handle system according to claim 5, wherein each of the at least one preload means is configured as a spring tongue which is configured from one material from the fastening element.

29. Door handle system according to claim 7, wherein the second section is configured for the attachment of the door handle at the carrier.

30. Door handle system according to claim 7, wherein the first section is configured for the attachment of the locking cylinder.

31. Door handle system according to claim 10, wherein the first part is connected to the second part by at least one of the connection devices.

32. Door handle system according to claim 14, wherein both of the connection devices extend linearly from the ends of the door handle and are adjusted mainly orthogonally to the longitudinal extension of the door handle.

33. Door handle system according to claim 15, wherein each of the respective connection devices comprises a different length.

34. Door handle system according to claim 16, wherein at least one start up slope is provided at at least the fastening means or the counter fastening means.

35. Door handle system according to claim 17, wherein a part of the at least one electronic unit is arrangeable in the door handle.

36. The method for the assembly of a door handle system according to claim 20, wherein the fastening element is exclusively linearly displaced.

37. The door handle according to claim 1, wherein the fastening element is configured to fix the door handle by adjustment of the fastening element from the release position to the fixing position.

* * * * *